US006085487A

United States Patent [19]

De Vlaam

[11] Patent Number: 6,085,487

[45] Date of Patent: Jul. 11, 2000

[54] METHOD AND DEVICE FOR STRAPPING INDIVIDUAL OBJECTS OR STACKS OF OBJECTS

[75] Inventor: Henk De Vlaam, Et Almere, Netherlands

[73] Assignee: Ferag Verpakkingstechniek B.V., Soest, Netherlands

[21] Appl. No.: 09/109,059

[22] Filed: Jul. 2, 1998

[30] Foreign Application Priority Data

Jul. 4, 1997 [CH] Switzerland ..... 1631/97

[51] Int. Cl.[7] ..... B65B 13/04; B65B 27/08

[52] U.S. Cl. ..... 53/176; 53/586; 53/589; 100/17

[58] Field of Search ..... 53/176, 586, 589, 53/591, 553; 100/17, 4

[56] References Cited

U.S. PATENT DOCUMENTS

| | | | |
|---|---|---|---|
| 4,509,314 | 4/1985 | Bozza | 53/586 |
| 4,831,809 | 5/1989 | Ballestrazzi et al. | 53/553 X |
| 4,867,053 | 9/1989 | Kawai et al. | 53/589 |
| 5,069,016 | 12/1991 | Grossi | 53/586 X |
| 5,373,686 | 12/1994 | Lang et al. | 53/589 |
| 5,423,161 | 6/1995 | Huson et al. | 53/586 X |

FOREIGN PATENT DOCUMENTS

| | | | |
|---|---|---|---|
| 113874 | 7/1984 | European Pat. Off. . | |
| 0 160 233 | 11/1985 | European Pat. Off. | B65B 27/08 |
| 0 612 661 | 8/1994 | European Pat. Off. | B65B 11/10 |
| 0 279 333 | 8/1998 | European Pat. Off. | B65B 27/08 |
| 21 56 651 | 5/1972 | Germany | B65B 27/08 |
| 31 40 291 | 4/1983 | Germany | B65B 27/08 |
| 33 40 628 | 10/1984 | Germany | B65D 85/16 |
| 3909223 | 10/1990 | Germany . | |
| 4421661 | 1/1996 | Germany . | |
| 1 282 769 | 7/1972 | United Kingdom | B65B 9/02 |

*Primary Examiner*—Linda Johnson
*Attorney, Agent, or Firm*—Lacasse and Associates; Randy W. Lacasse; Kevin E. Greene

[57] ABSTRACT

Objects or stacks (S) conveyed sequentially into a strapping position (U) are strapped in the strapping position (U) selectively with a first strapping or wrapping material (A/A') parallel to the conveying direction and/or with a second strapping material (B) perpendicular to the conveying direction. For the parallel strapping, the first strapping or wrapping material (A/A') is positioned across the conveying path of the objects or stacks in the entry of the strapping position (U) and this first strapping or wrapping material is closed and cut behind each object or stack to form a strapping or wrapping, whereby the first material is simultaneously reconnected and repositioned for the next object or stack. Perpendicular strapping is carried out by means of a loop channel (32) arranged substantially perpendicular to the conveying path. For objects or stacks which are not to be strapped parallel to the conveying direction, the first strapping or wrapping material is shifted out of the conveying path.

9 Claims, 5 Drawing Sheets

62
2
3
S'
F
13
U
14
61
S
C
60
14

METHOD AND DEVICE FOR STRAPPING INDIVIDUAL OBJECTS OR STACKS OF OBJECTS

The invention belongs to packaging technology and concerns a method and a device according to the generic terms of the corresponding independent claims. The method and the device serve for strapping substantially parallelepipedic objects or stacks of objects such as e.g. stacks of newspapers or magazines which objects or stacks are conveyed in succession into a strapping position and after strapping are conveyed away from the strapping position.

According to the state of the art, objects or stacks of objects supplied on a conveying path are strapped perpendicular to the conveying direction (perpendicular strapping) with the help of a tape channel forming a loop around the conveying path, in the region of which tape channel the object to be strapped is stopped. A loop of tape positioned in the tape channel is then pulled out of the tape channel, is tightened around the object and is closed around the object e.g. by welding.

For strapping an object parallel to the conveying direction (parallel strapping), a corresponding tape channel can be used providing that the tape channel does not obstruct the conveying away of the strapped object. This is e.g. made possible by designing the tape channel or a part thereof to be movable such that it can be removed from the conveying path (e.g. DE-4421661) before the strapped object is conveyed away or by arranging parts of the tape channel, which could obstruct the conveying away, sideways of the conveying path and by moving the tape into the region of the conveying path only when the tape is pulled out of the tape channel (DE-4230730).

According to the state of the art, objects are also strapped in two directions substantially perpendicular to each other (crosswise strapping). This is e.g. done by means of a plurality of devices, as described above, which devices are arranged behind each other or are integrated into each other. Simple such arrangements comprise two strapping devices each equipped for perpendicular strapping and being arranged after each other, whereby the conveying direction of the objects to be strapped is changed by 90° between the two devices or the objects to be strapped are turned by 90° between the two devices.

Devices for simultaneous perpendicular and parallel strapping (crosswise strapping) with the help of tape channels are e.g. described in the publications DE-3909223 and U.S. Pat. No. 5,078,057. These devices are costly in what regards mechanics and control. Furthermore, the methods with tape channels, especially for parallel strapping, are restricted to narrow strapping material, i.e. they are only applicable for strapping but not for wrapping with a wider material (e.g. foil material). Tape channels can be designed in a comparatively simple manner only as long as strapping material having a sufficient stability for being able to be pushed into the channel is used.

This is also valid for a relatively simple device with two tape channels (DE-3303956) arranged obliquely to the conveying direction, whereby the objects to be strapped are conveyed into this strapping position with their diagonal oriented parallel to the conveying direction.

For parallel strapping, it is also known to supply strapping material (eg. tape) from two opposite sides of the conveying path (top/bottom, left/right). The ends of the two tapes each supplied from one side are connected to each other such that the tape extends across the conveying path in a curtain-like manner. The object or stack is conveyed against the tape extending across the conveying path such that the tape comes to lie on the front side of the object or stack and is pulled in conveying direction by the object or stack. When the rear side of the object to be strapped has passed the location of the tape-curtain the tape is tensioned round the object, is closed on the rear side of the object and is cut off in such a way that the object is strapped parallel to the conveying direction and for the following object the cut-off ends of the tape are connected again and the tape is again extending across the conveying path.

Devices for carrying out this kind of parallel strapping are e.g. described in the publications EP-225665, EP-592049, DE-2548786 or DE-2513668. In these same publications devices for connecting and cutting the tape supplied from the two tape sources are also described.

Devices which feed the strapping material from only one side and move the free tape end across the conveying path with the help of a movable gripper or similar mechanical means and close it around the object to be strapped work according to the same principle.

Strapping by means of conveying the object to be strapped against a strapping material extending across the conveying path is applicable (like the methods using tape channels described further above) for relatively narrow and relatively stiff strapping tapes. It is however easily adaptable for the use of wider strapping materials and for the use of strapping materials which are not at all or hardly stiff. Therefore, objects and stacks of objects can also be e.g. "strapped" with thin films of plastic which have substantially the same width as the objects to be strapped or are even wider than these. In this case the "strapping" is preferably called wrapping.

The publication EP-113874 describes a combination of parallel strapping as described above and perpendicular strapping. In this combination it is not possible however, to tension the strapping material which is positioned around the object parallel to the conveying direction, i.e. it is useable only for tensionless wrapping.

The object of the invention is to show a method for strapping substantially parallelepipedic objects or stacks being conveyed to a strapping position in succession. With the inventive method it is to be possible to produce stable strapping with a simple device and largely independent of the strapping material (different widths, different demands on the tension necessary for the strapping). Additionally, the method is to make possible a high flexibility concerning the type of strapping (parallel, perpendicular, crosswise), whereby the cycle time is to be substantially independent of the desired type of strapping and whereby apart from the stop in the strapping position the conveying of the objects to be strapped is to be as continuous and straight forward as possible. Furthermore it is an object of the invention to create a device for carrying out the method.

This object is achieved by the method and the device as defined in the claims.

The inventive method is based on a combination of parallel strapping using a first strapping material extending across the conveying path (strapping parallel to the conveying direction) and perpendicular strapping e.g. with the help of a channel loop arranged perpendicular to the conveying path (strapping perpendicular to the conveying path). The first strapping material is extending across the conveying path at the entry to a strapping position and the channel loop is e.g. arranged in the middle of the same, sole strapping position (for a substantially central perpendicular strapping) such that the first strapping material is already slung around the object to be strapped when this object stops in the strapping position. As soon as the object stops in the strapping position the second strapping material (perpendicular strapping) is pulled from the channel, is tensed, closed and cut off substantially at the same time as the first strapping material (parallel strapping) is tensed, closed and cut off. In particular for strapping compressible objects or stacks, correspondingly designed and driven pressing and possibly stabilizing means are to be provided for the parallel and the perpendicular strapping to get the desired tension, whereby the tension of the one strapping is independent of the tension of the other strapping.

For objects which are to be strapped only parallel to the conveying direction, perpendicular strapping is not activated. For objects which are to be strapped perpendicular to the conveying direction only, the first strapping material extending across the conveying path is displaced such that it extends beside the conveying path or above the conveying path and the object can pass without pulling the strapping material with it. For a multiple perpendicular strapping the object can be slightly shifted in the strapping position or a plurality of tape channels can be provided. For a multiple parallel strapping several strapping materials can be extended across the conveying path. The strapping material for the parallel strapping can be a strapping tape or a wider wrapping material such as e.g. a plastic film. This kind of wrapping material has any width, i.e. it is e.g. of the same width as the objects or stacks to be wrapped or wider than these.

In the following Figures, the inventive method is illustrated by means of a diagrammatically represented, exemplified embodiment of the inventive device, whereby FIG. 1 to 6 show successive phases of the inventive method, used for parallel and/or perpendicular strapping of stacks of newspapers or magazines viewed perpendicular to the conveying path (FIGS. 1 and 4 to 6) and viewed parallel to the conveying path (FIGS. 2 and 3);

Figure 1:
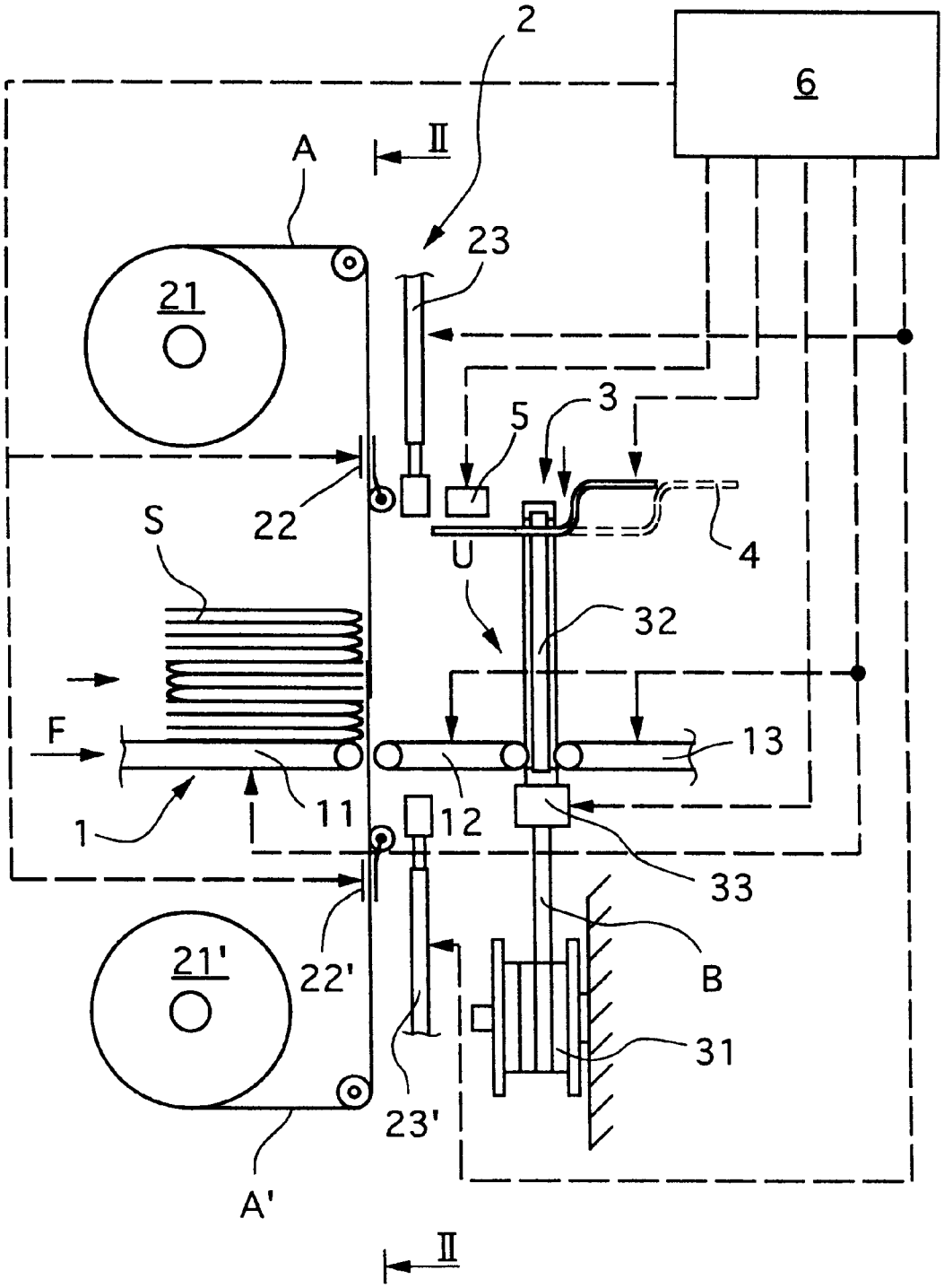

FIGS. 1 and 4 to 6 very diagrammatically show an exemplified embodiment of the device for carrying out the inventive method viewed perpendicular to the conveying direction F in which direction a stack S to be strapped is conveyed into a strapping position U and the strapped stack S' is conveyed out of the strapping position U.

The strapping position U is equipped with the following means:

conveying means 1 for conveying stacks S to be strapped on a conveying path into the strapping position U and for conveying away strapped stacks S' out of the strapping position U, parallel strapping means 2 for positioning a first strapping material A/A' across the conveying path and for tensioning, closing and cutting off the first strapping material behind a stack S, perpendicular strapping means 3 for forming a loop from a second strapping material B perpendicular to the conveying direction and for tensioning, closing and cutting off the second stapping material, possibly, displacing means for displacing the first strapping material A/A' out of the conveying path, front and possibly rear pressing and stabilizing means 4 and 5 for pressing and stabilizing a stack S when being conveyed into the strapping position U and during strapping and possibly for tensioning the first strapping material A, and control means 6 for controlling the named means 1 to 5 and the displacing means for strapping stacks conveyed into the strapping position U selectively parallel and/or perpendicular to the conveying direction.

The conveying means 1 is e.g. designed to be conveying belts 11, 12 and 13 between which a gap for the first strapping material is provided at the entry of the strapping position U as well as a gap e.g. in the middle of the strapping position U for the loop made of the second strapping material B.

The means 2 for parallel strapping substantially comprise an upper and a lower storage reel 21 and 21' of the first strapping material A/A' and upper and lower braking/guiding means 22 and 22' for guiding the strapping material and for tensioning it as well as mutually co-operating means 23 and 23' for tensioning, closing and cutting off the first strapping material. This kind of means 2 for parallel strapping belong to the state of the art and can be adapted for the inventive device without detailed description by one skilled in the art.

Possibly, the braking/guiding means 22 and 22' are arranged movably in a coordinated manner and perpendicular to the conveying direction F such that they can displace the curtain extending across the conveying path to one side of the latter (in FIG. 1 perpendicular to the plane of the paper). Such movable braking/guiding means adopt the function of the displacing means.

Figure 2:
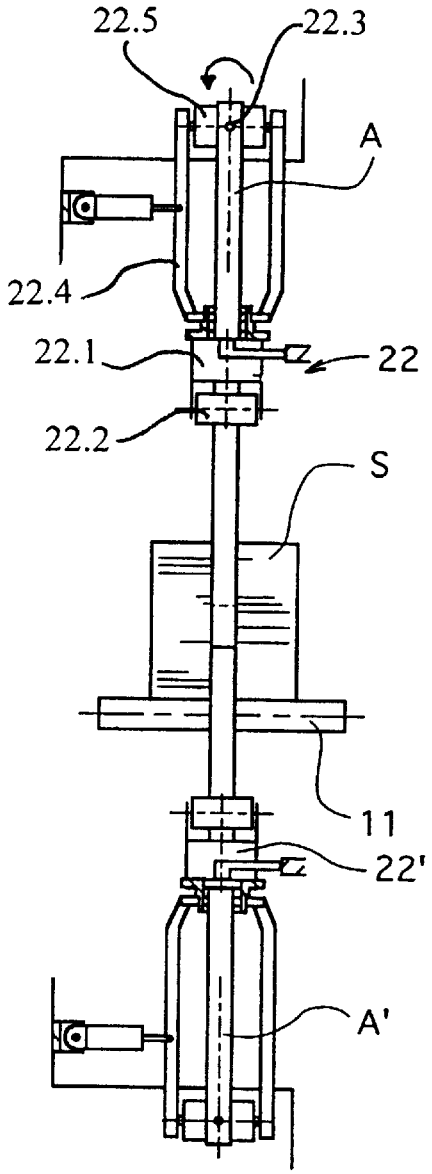
Figure 3:
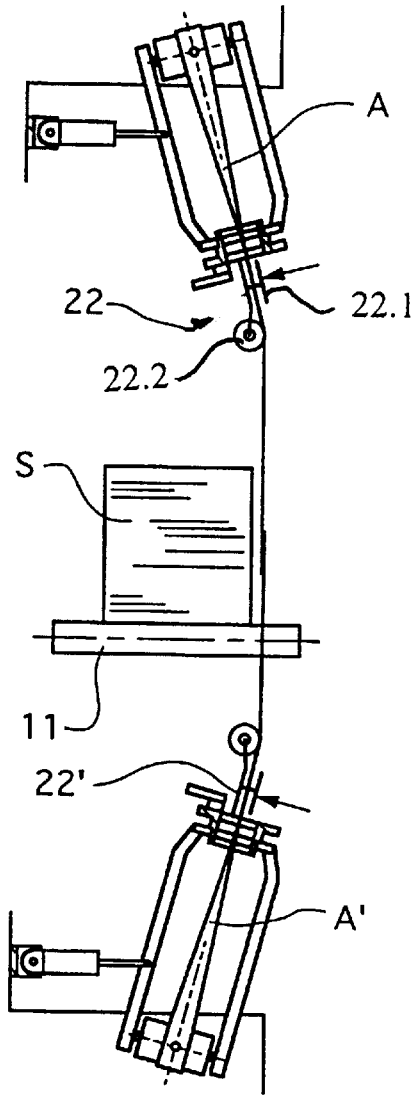
Figure 4:
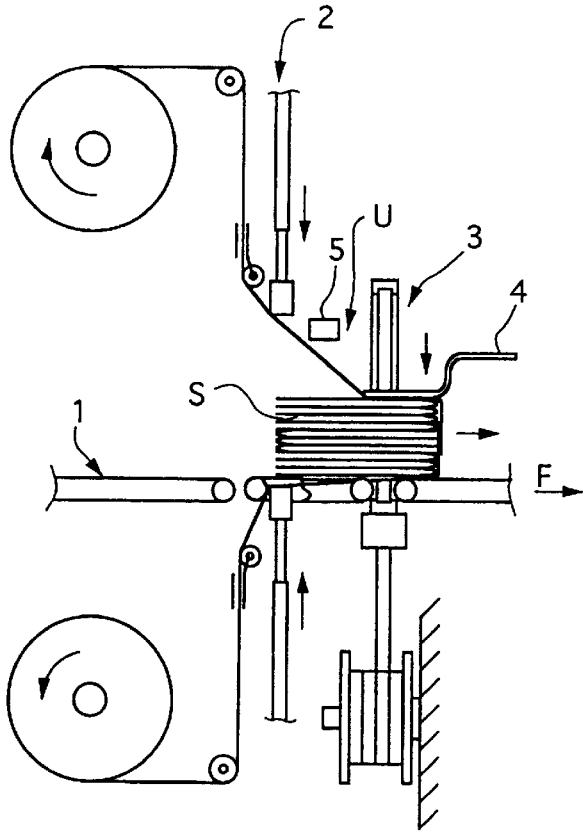
Figure 5:
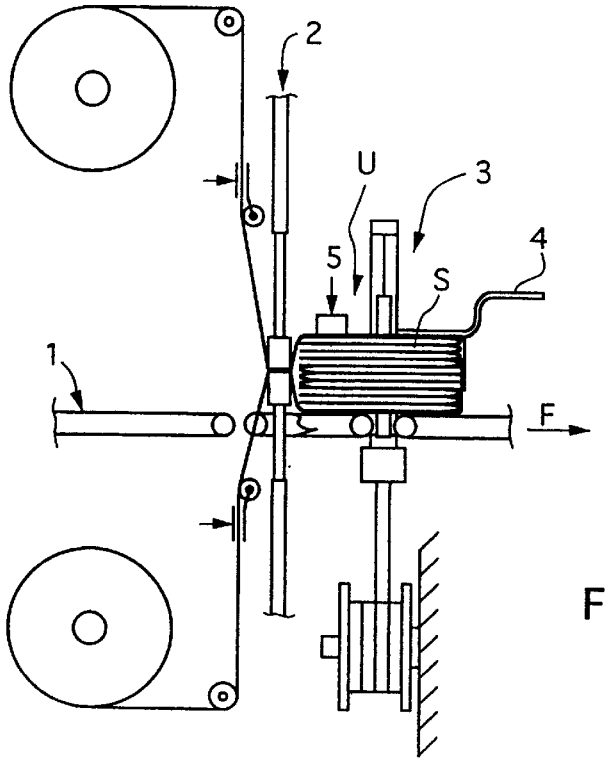
Figure 6:
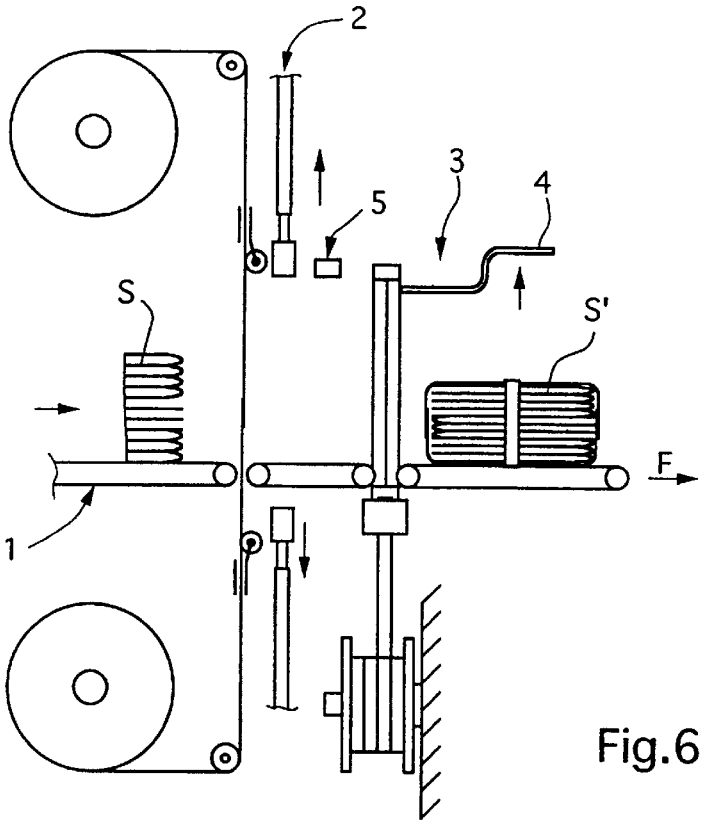

FIGS. 2 and 3 show, viewed parallel to the conveying direction, such braking/guiding means 22 and 22' in their operating position (FIG. 2) in which they position the first strapping means A/A' to extend across the conveying path and in a non-operating position (FIG. 3) in which they position the first strapping material on the one side of the conveying path. The braking/guiding means 22 and 22' e.g. consist of a pair of clamping or braking jaws 22.1 and a guiding roller 22.2 which are movable with the help of a lever 22.4 pivotal around an axis 22.3 in a plane perpendicular to the conveying path. Depending on the width and elasticity of the strapping material it is advantageous to rotate the pair of braking jaws 22.1 and the guiding roller 22.2 and thus the strapping material by 90° and to also pivot the adjacent deflection roller (e.g. deflection roller 22.5), as shown in FIGS. 2 and 3.

The means 3 for perpendicular strapping substantially consists of a storage reel 31 for the second strapping material B, of a tape channel 32 arranged around the conveying path in form of a loop and of means 33 for introducing the second strapping material B into the loop channel 32 and for positioning the tape loop around the stack as well as for tensioning, closing and cutting off the second strapping material. This kind of means 3 for perpendicular strapping belong to the state of the art and can be adapted without detailed description to the inventive device by one skilled in the art (see the publication cited in the beginning for the state of the art).

In particular, for tensed strapping of compressible stacks or objects, the device further comprises front and possibly rear pressing and stabilizing means 4 and 5. The front pressing and stabilizing means 4 substantially affects the front part of the stack and is cyclically movable such that it presses on the stack S already when the stack is being conveyed into the strapping position, thereby preventing the individual objects (newspapers or magazines) from being shifted relative to each other in the direction of the conveying path by the effect of the curtain of the first strapping material A/A'. Depending on the requirements concerning the parallel strapping and its tension, the front pressing and stabilizing means comprise a gap through which the first strapping material runs. Thus, it does not affect the first strapping material. On the other hand it may also press on the first strapping material and thus contribute to the tension of the first strapping material around the front part of the stack to be strapped.

The rear pressing and stabilizing means 5 acts on the rear part of the stack and is designed e.g. as a pair of pressing pieces which can be moved up and down and between which there is a gap for the first strapping material.

Stabilizing means arranged on the sides of the stack to be strapped, as known from strapping devices according to the state of the art, can be provided for strapping unstable stacks.

Data concerning the stacks to be strapped are made available to the controlling means 6 (shown diagrammatically in FIG. 1 as a box connected to the device parts to be controlled by data lines illustrated as broken lines). By means of this data the controlling means decide whether a stack is to be strapped parallel, perpendicular, crosswise (parallel and perpendicular) or not at all and control the parts of the device accordingly. By means of this data, it may be decided also how far the elements of the device (e.g. elements 23, 4, 5) are to be moved in order to convey a stack to be strapped into the strapping position without problems, i.e. how large the minimally necessary movement is for removing these elements out of the conveying path.

Before a stack S (FIG. 1) to be strapped parallel and perpendicular is conveyed into the strapping position, the following device configuration is established with the help of the control means 6: conveying means 1 in operation, braking/guiding means 22/22' in an operative home position (first strapping material extending across the conveying path but no being braked), means 23/23' in home position above and below the conveying path, the loop of the second strapping material B ready in the loop channel 32, the front pressing and stabilizing means 4 in a starting position is above the conveying path (e.g. shown in its back most position relative to the conveying direction), the rear pressing and stabilizing means 5 also in its starting position above the conveying path. The position of the front pressing and stabilizing means 4 shown in broken lines is a home position in which it does not reach into the region of loop channel 32.

On conveying of a stack to be strapped into the strapping position U, the first strapping material extending across the conveying path and being supplied from the two reels 21 and 21' is drawn in conveying direction also, whereby for a fast supply known tape storage means can be provided between the reels and the conveying path.

When the stack S has reached the starting position of the front pressing and stabilizing means 4 (FIG. 4) the latter is lowered onto the stack and conveyed in conveying direction F while pressing onto the stack. For very unstable stacks which may be disorganized by the strapping material to be drawn, the front pressing and stabilizing means must be designed and moved such that it accompanies the stack such stabilizing it already when the stack meets with the first strapping material extending across the conveying path.

When the stack is positioned in the strapping position U (FIG. 5) the following operations are activated: conveying means 1 (in particular the conveying belts 12 and 13) are stopped and the rear pressing and stabilizing means is lowered onto the stack, braking/guiding means 22/22' are brought into a braking position, means 23/23' are brought into an active position and are activated for connecting and cutting off the first strapping material A/A' and at the same time the means 33 for the perpendicular strapping is activated.

When the two strappings have been formed (FIG. 6), the following operations are activated: the front and rear pressing and stabilizing means 4 and 5 are raised above the conveying path, means 23/23' are moved out of the conveying path, conveying means 1 is started, the braking/guiding means 22/22' are brought into their home position, a new loop of second strapping material B is positioned in the loop channel.

Due to the adjustment of the height of the home position of the upper means 23 and of the starting position of the pressing and stabilizing means 4 and 5 to the height of a following stack, the cycle time for stacks with small height can be reduced and thus the mean cycle time is reduced.

For stacks which are only to be strapped perpendicular to the conveying direction, the first strapping material A/A' is displaced out of the conveying path by correspondingly displacing the portion extending across the conveying path or by displacing the braking/guiding means 22/22' out of the conveying path and possibly back into the conveying path for the next stack. Operating and non-operating positions of the braking/guiding means are shown in FIGS. 2 and 3.

For stacks which are only to be strapped parallel to the conveying direction, means 3 is not activated.

It is obviously also possible to let a stack (possibly only consisting of one specimen) pass through the strapping position (possibly without stopping it) without performing any strapping whatsoever.

For identical strapping of identical stacks obviously a series of control procedures can be left out and for this reason the corresponding means can be designed to be more simple.

For strapping of objects as opposed to strapping of stacks, the first strapping material A/A' can extend horizontally across the conveying path instead of vertically.

Figure 7:
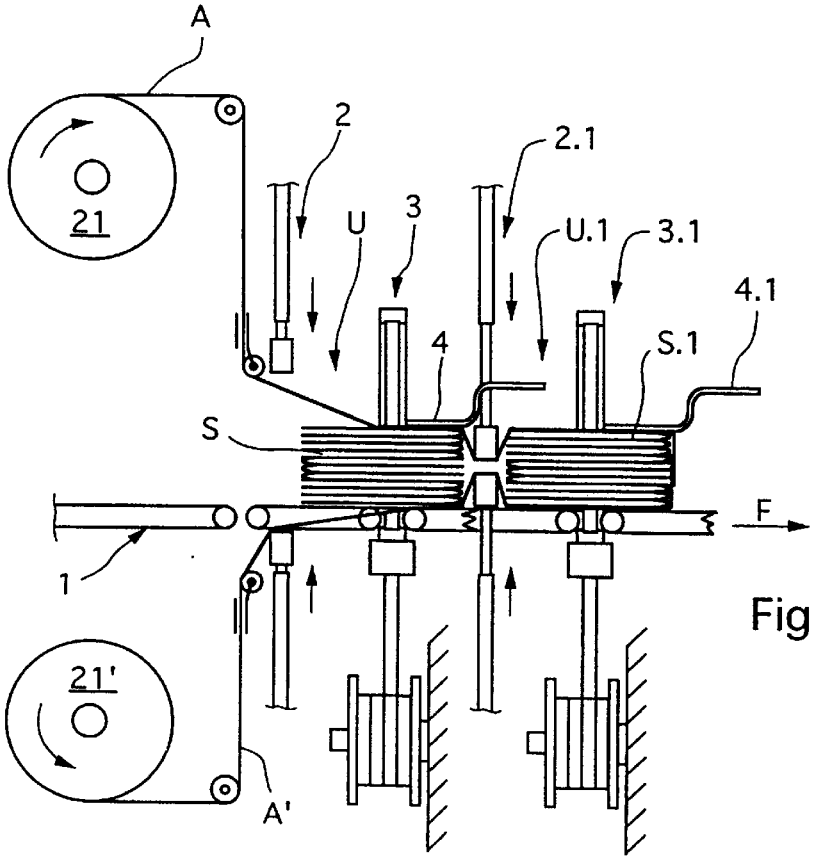
FIG. 7 shows a tandem device for carrying out the inventive method.

FIG. 7 shows a further embodiment of the inventive device. It is a tandem device with which two objects or stacks are strapped per cycle time. The device substantially consists of two devices according to FIG. 1 to 6 which devices are arranged in direct succession (device parts denominated with the same reference numbers or with the same reference numbers with .1 as the corresponding device parts in FIGS. 1 to 6).

For the two devices, only one curtain of first strapping material A/A' is provided which first strapping material is laid around both stacks S and S.1 and is tensioned, closed and cut off in immediate succession first behind the front stack S.1 and then behind the following stack S.

With the help of the device as shown in FIG. 7, the strapping time can be reduced, whereby not the double amount of equipment is required (only two storage reels 21 and 21' for the first strapping material A/A'). However, because of a pair of successive stacks S and S.1 only both or none of them can be strapped parallel to the conveying direction, the flexibility of the device according to FIGS. 1 to 6 is not quite maintained in the tandem device according to FIG. 7.

Figure 8:
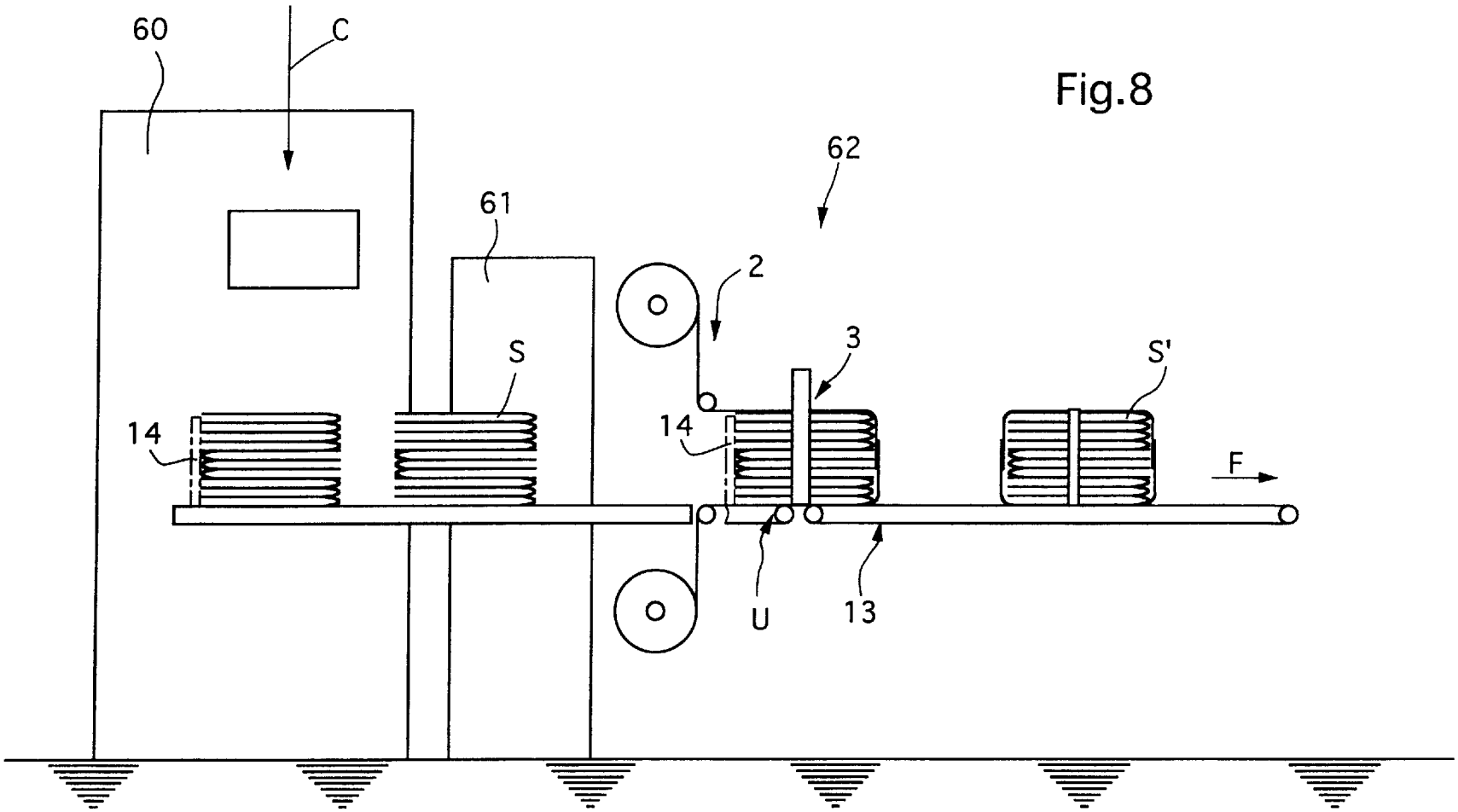
FIG. 8 shows a device for carrying out the inventive method which device is integrated in an arrangement for producing cross-stacks, for equipping the stacks with a covering sheet and for selectively strapping the stacks parallel and/or perpendicular to the conveying direction.

FIG. 8 shows the integration of an inventive device into a processing line to which individual printed products such as newspapers or magazines are supplied (arrow C) and are then stacked in part stacks, the part stacks being assembled in alternating direction to cross-stacks S with the help of a stacking device 60 having a turntable. The cross-stacks S are conveyed to a printer and a sheet feeder 61 with the help of a pusher 14. With the help of the printer and the sheet feeder the stack is equipped with a covering sheet. Additionally to or instead of the covering sheet other carriers of information can be added. Again with the help of a pusher 14 the equipped stack is moved into the strapping position U of the inventive device 62 and is strapped in the manner described in detail above.

From the combined example shown in FIG. 8 it is obvious how compact such a processing line or a similar one can be designed when using the inventive device. This is not only advantageous regarding the little space used but also makes the conveying paths for the stacks which are not yet strapped and thus are sensitive extremely short and thus free of problems.

The combination of components of this kind of processing line is individually applicable. Here the location 61 also serves as a tranquillising zone into which the stack is introduced at a relatively high speed, in which it is stabilized laterally and if necessary stopped and out of which it is conveyed at a lower speed. This kind of treatment frees the processing of very unstable stacks from problems.

What is claimed is:

1. A device for selectively strapping substantially parallelepipedic objects, or compressible stacks of flat objects being conveyed in a conveying direction, parallel and/or perpendicular to the conveying direction, the device comprising:

conveying means for conveying said objects on a conveying path to only one strapping position, for stopping each object in succession in the strapping position and for conveying strapped objects away from the strapping position, means for parallel strapping comprising displaceable means for selectively positioning a first strapping material across the conveying path at an entrance of the strapping position or removing said first strapping material from the conveying path and means for tensioning, closing and separating said first strapping material on an upstream side of each object positioned in the strapping position, means for perpendicular strapping comprising means for positioning in the strapping position a second strapping material in a bow across the conveying path and means for tensioning and closing said second strapping material around an object positioned in the strapping position, means for stabilizing and pressing at least a downstream part of each object during conveyance into the strapping position and during strapping, and control means for selectively controlling for selective parallel strapping or perpendicular strapping or simultaneous parallel and perpendicular strapping, the conveying means, the means for parallel strapping, the means for perpendicular strapping and the stabilizing and pressing means.

2. A device according to claim 1, comprising pressing means for pressing the upstream part of objects positioned in the strapping position.

3. A device according to claim 1, wherein conveying belts or pushers are provided as conveying means.

4. A device according to claim 1, wherein the means for parallel strapping comprises two storage reels for providing first strapping material, two means for braking and guiding said first strapping material and two means for tensioning, connecting and separating said second strapping material.

5. A device according to claim 4, wherein the braking and guiding means are movable for displacing the first strapping or wrapping material extending across the conveying path.

6. A device according to claim 5, wherein the braking and guiding means comprise of a pair of clamping jaws and a guiding roller on a pivotable holder.

7. A device according to claim 6, wherein the pair of clamping jaws and the guiding roller are additionally rotatable by 90° relative to the holder.

8. A device according to claim 1, wherein the means for perpendicular strapping comprise a storage reel for the second strapping material, a channel forming a bow around the conveying path, and means for introducing the second strapping material into the channel, and means for pulling the second strapping material from the channel, for tensioning it around an object positioned in the strapping position and for closing it around the object and separating it from the storage reel.

9. A device according to claim 1, comprising a double strapping position for strapping two objects, one at a time.

* * * * *